US006938330B2

(12) United States Patent
Haws et al.

(10) Patent No.: US 6,938,330 B2
(45) Date of Patent: Sep. 6, 2005

(54) METHOD AND APPARATUS FOR INSERTING SLIDERS DURING AUTOMATED MANUFACTURE OF RECLOSABLE BAGS

(75) Inventors: Lewis Albert Haws, Duluth, GA (US); David C. Wallace, Lilburn, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/622,996

(22) Filed: Jul. 18, 2003

(65) Prior Publication Data

US 2005/0015956 A1 Jan. 27, 2005

(51) Int. Cl.[7] ..... A41H 37/06

(52) U.S. Cl. ..... 29/768; 29/766; 29/409; 29/410; 29/33.2

(58) Field of Search ..... 29/408, 409, 410, 29/33.2, 34, 766–769

(56) References Cited

U.S. PATENT DOCUMENTS

| | | | | |
|---|---|---|---|---|
| 3,426,396 A | 2/1969 | Laguerre | ..... | 24/201 |
| 3,701,191 A | 10/1972 | Laguerre | ..... | 29/207.5 |
| 3,701,192 A | 10/1972 | Laguerre | ..... | 29/207.5 |
| 6,088,887 A | 7/2000 | Bois | ..... | 24/399 |
| 6,131,369 A | 10/2000 | Ausnit | ..... | 53/412 |
| 6,477,821 B1 | 11/2002 | Bois | ..... | 53/412 |

FOREIGN PATENT DOCUMENTS

| | | | | |
|---|---|---|---|---|
| GB | 2085519 | * | 4/1982 | |
| WO | 2004/0020035 | | 2/2004 | ..... 29/768 |

* cited by examiner

*Primary Examiner*—Eric Compton
(74) *Attorney, Agent, or Firm*—Ostrager Chong Flaherty & Broitman PC

(57) ABSTRACT

Methods and apparatus for automated insertion of sliders on continuous zipper material. The method involves the following steps: (a) advancing a section of zipper material past a leading edge of a splitter plate that pries the zipper strips of the zipper material apart; (b) clamping a first portion of one zipper strip against one side of the splitter plate, while clamping a first portion of the other zipper strip against an opposite side of the splitter plate, the first portions of the zipper strips being disposed on an upstream side of a slider insertion zone; (c) closing a portion of the zipper comprising respective second portions of the zipper strips disposed on a downstream side of the slider insertion zone; and (d) inserting a slider onto the zipper in the slider insertion zone. A plow of the slider is disposed between respective third portions of the zipper strips. The proximity of closed zipper to the closing end of the slider and the presence of open zipper at the opening end of the slider and adjacent the plow facilitates insertion of the slider onto the zipper.

22 Claims, 8 Drawing Sheets

METHOD AND APPARATUS FOR INSERTING SLIDERS DURING AUTOMATED MANUFACTURE OF RECLOSABLE BAGS

BACKGROUND OF THE INVENTION

This invention generally relates to methods and apparatus for inserting sliders onto zippers for use in reclosable packaging, such as zippered bags or pouches. In particular, the invention relates to slider insertion devices incorporated in machines for making reclosable packages having slider-operated zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger or plow in the middle or at one end that is inserted between the zipper profiles to force them apart as the slider is moved along the zipper in an opening direction. The other end of the slider is sufficiently narrow to force the zipper profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Until recently, slider-operated, separately extruded zippers used flange-type constructions.

An alternative zipper design is the so-called flangeless or string zipper, which has substantially no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

Recently, slider-operated, separately extruded zippers that do not use flange-type constructions have been disclosed. U.S. patent application Ser. No. 10/367,450 discloses a reclosable bag in which respective marginal portions of the bag film are sealed to the backs of respective flangeless zipper strips. The resulting string zipper is actuated by means of a straddling-type slider having a plow that separates the zipper strips during opening. U.S. patent application Ser. No. 10/436,433 discloses methods and apparatus for manufacturing reclosable bags having slider-actuated string zippers, including methods and apparatus for inserting sliders with plows on string zippers. These methods and apparatus may also have application for inserting sliders with plows on flanged zippers or zippers that have been coextruded with the bag.

When inserting a slider having a plow on a zipper, the zipper section where the slider is inserted must be maintained in an open state to allow the slider plow to project between the zipper profiles, but at the same time the side walls of the slider must be able to pass over and straddle the zipper profiles. However, difficulties arise when one attempts to insert the closing end of a slider over an open zipper using an automated insertion device.

There is a continuing need for improved methods and apparatus for automated insertion of sliders with plows on zippers.

BRIEF DESCRIPTION OF THE INVENTION

The present invention is directed to methods and apparatus for automated insertion of sliders on zippers. Although the disclosed embodiments insert sliders on string zippers joined to bag making film, the invention also has application in the manufacture of reclosable slider bags having a flanged zipper attached to the bag making film or slider bags wherein the zipper and bag making film are co-extruded. Furthermore, the invention has separate application in cases where sliders need to be pre-loaded onto flanged zipper material before attachment to of the zipper flanges to bag making film.

One aspect of the invention is an apparatus comprising: a pusher movable from a retracted position to an extended position for inserting a slider onto a first section of a zipper comprising mutually interlockable first and second zipper strips; first and second guides disposed on opposite sides of a second section of the zipper; first and second grippers respectively disposed on opposite sides of a third section of the zipper disposed between the first and second sections, each of the first and second grippers being movable between respective extended and retracted positions to grip the zipper when the grippers are in the extended positions and to not grip the zipper when the grippers are not in the extended positions; third and fourth grippers respectively disposed on opposite sides of a fourth section of the zipper, the first sections being disposed between the third and fourth sections, each of the third and fourth grippers being movable between respective extended and retracted positions to grip the zipper when the grippers are in the extended positions and to not grip the zipper when the grippers are not in the extended positions; and a splitter plate disposed between the first and second zipper strips along the second and third sections.

Another aspect of the invention is a slider insertion machine comprising: a pusher movable from a retracted position to an extended position for inserting a slider into a predetermined volume of space and onto a zipper that spans the predetermined volume of space; and first and second clamps respectively disposed on opposite sides of the zipper, each of the first and second clamps being movable between respective extended and retracted positions to clamp the zipper on opposite sides of the predetermined volume of space when the clamps are in the extended positions and to not clamp the zipper when the clamps are not in the extended positions.

A further aspect of the invention is a method of inserting a slider onto continuous zipper material, comprising the following steps: (a) opening a section of zipper material by disengaging first and second zipper strips from each other; (b) clamping a first portion of the first zipper strip against one side of a plate, the first portion of the first zipper strip forming part of the open section of the zipper and being disposed on one side of a slider insertion zone; (c) clamping a first portion of the second zipper strip against an opposite side of the plate, the first portion of the second zipper strip forming part of the open section of the zipper and being disposed on the one side of the slider insertion zone; (d) clamping a second portion of the first zipper strip against a second portion of the second zipper strip, the second portions of the first and second zipper strips forming a closed section of the zipper and being disposed on an opposite side of the slider insertion zone; and (e) inserting a slider onto the zipper in the slider insertion zone, with a plow of the slider being disposed between respective third portions of the first and second zipper strips. Step (e) is performed after steps (a) through (d).

Another aspect of the invention is a slider insertion machine comprising: a stationary splitter plate for opening a section of zipper material by disengaging first and second zipper strips from each other; first means for clamping a first portion of the first zipper strip against one side of the splitter plate, the first portion of the first zipper strip forming part of the open section of the zipper and being disposed on one side of a slider insertion zone; second means for clamping a first portion of the second zipper strip against an opposite side of the splitter plate, the first portion of the second zipper strip forming part of the open section of the zipper and being disposed on the one side of the slider insertion zone; third means for clamping a second portion of the first zipper strip against a second portion of the second zipper strip, the second portions of the first and second zipper strips forming a closed section of the zipper and being disposed on an opposite side of the slider insertion zone; and a pusher for inserting a slider onto the zipper in the slider insertion zone, with a plow of the slider being disposed between respective third portions of the first and second zipper strips.

Yet another aspect of the invention is a method of inserting a slider onto continuous zipper material, comprising the following steps: (a) advancing a section of zipper material past a leading edge of a splitter plate that pries first and second zipper strips of the zipper material apart during advancement; (b) clamping a first portion of the first zipper strip against one side of the splitter plate, the first portion of the first zipper strip being disposed on one side of a slider insertion zone; (c) clamping a first portion of the second zipper strip against an opposite side of the splitter plate, the first portion of the second zipper strip being disposed on the one side of the slider insertion zone; (d) closing a portion of the zipper comprising a second portion of the first zipper strip and a second portion of the second zipper strip, the second portions of the first and second zipper strips being disposed on an opposite side of the slider insertion zone; and (e) inserting a slider onto the zipper in the slider insertion zone, with a plow of the slider being disposed between respective third portions of the first and second zipper strips. Steps (b) through (e) are performed during a dwell time after step (a), and step (e) is performed after steps (b) through (d).

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
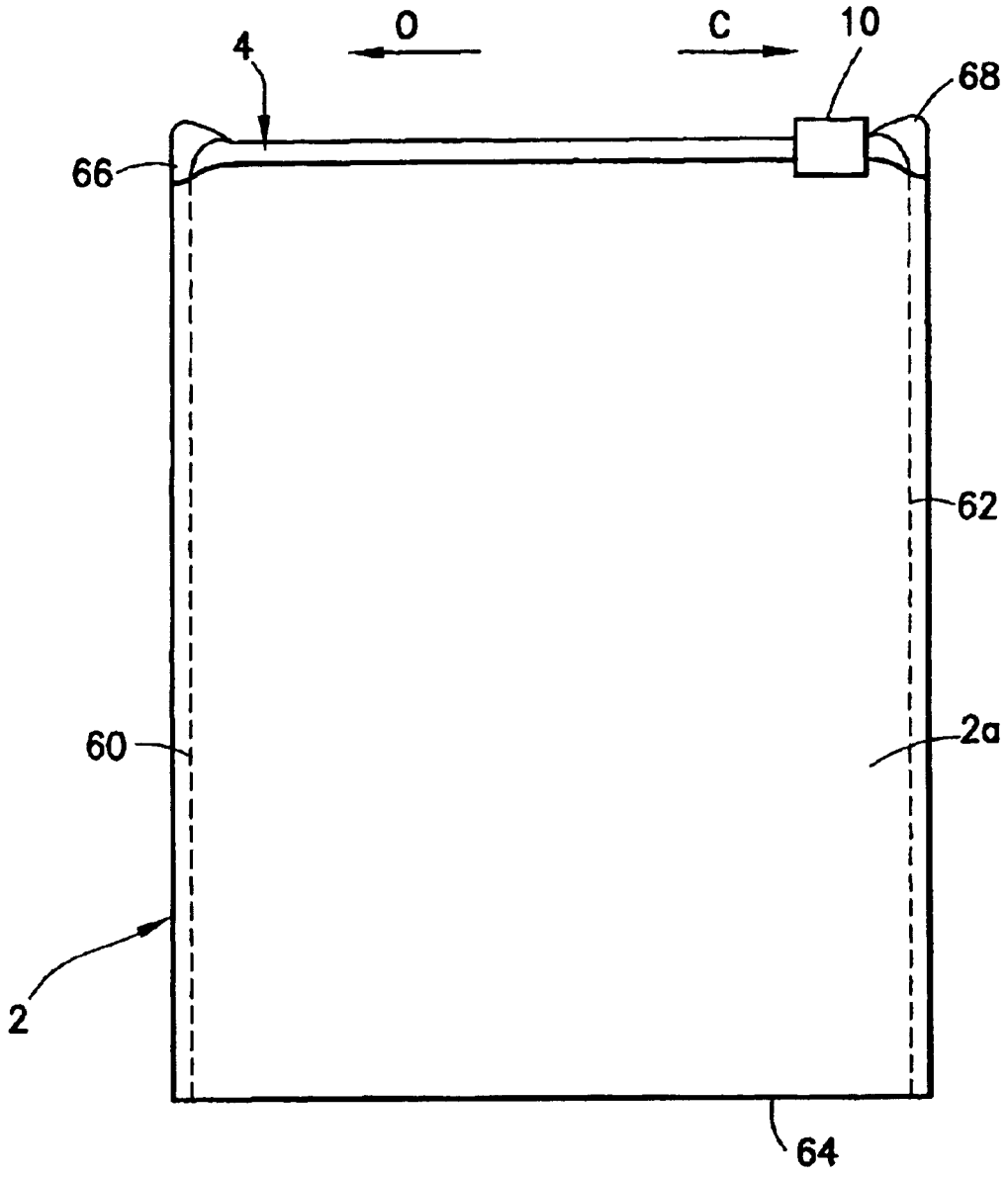
FIG. 1 is a drawing showing a reclosable package having a slider-operated zipper with end stops.

A reclosable package or bag comprising a receptacle 2 and a flexible plastic string zipper 4, operated by manipulation of a slider 10, is shown in FIG. 1, adapted from U.S. patent application Ser. No. 10/367,450. The present invention is directed to methods and apparatus for making reclosable bags of the type shown in FIG. 1 as well as other types of reclosable packages having different structures. For example, the methods and apparatus disclosed herein can be used to insert a slider having a plow not only on a string zipper attached to packaging film, but also on a flanged zipper attached to packaging film or a zipper co-extruded with packaging film.

Referring to FIG. 1, the receptacle 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The receptacle 2 comprises opposing walls (only the front wall 2*a* is visible in FIG. 1) that may be secured together at opposite side edges of the bag by seams 60 and 62 (indicated by dashed lines). The opposing bottoms of the walls may be joined, for example, by means of a heat seal made in conventional fashion, e.g., by application of heat and pressure. Typically, however, the bottom of the package is formed by a fold 64 in the original packaging film, as depicted in FIG. 1.

Figure 2:
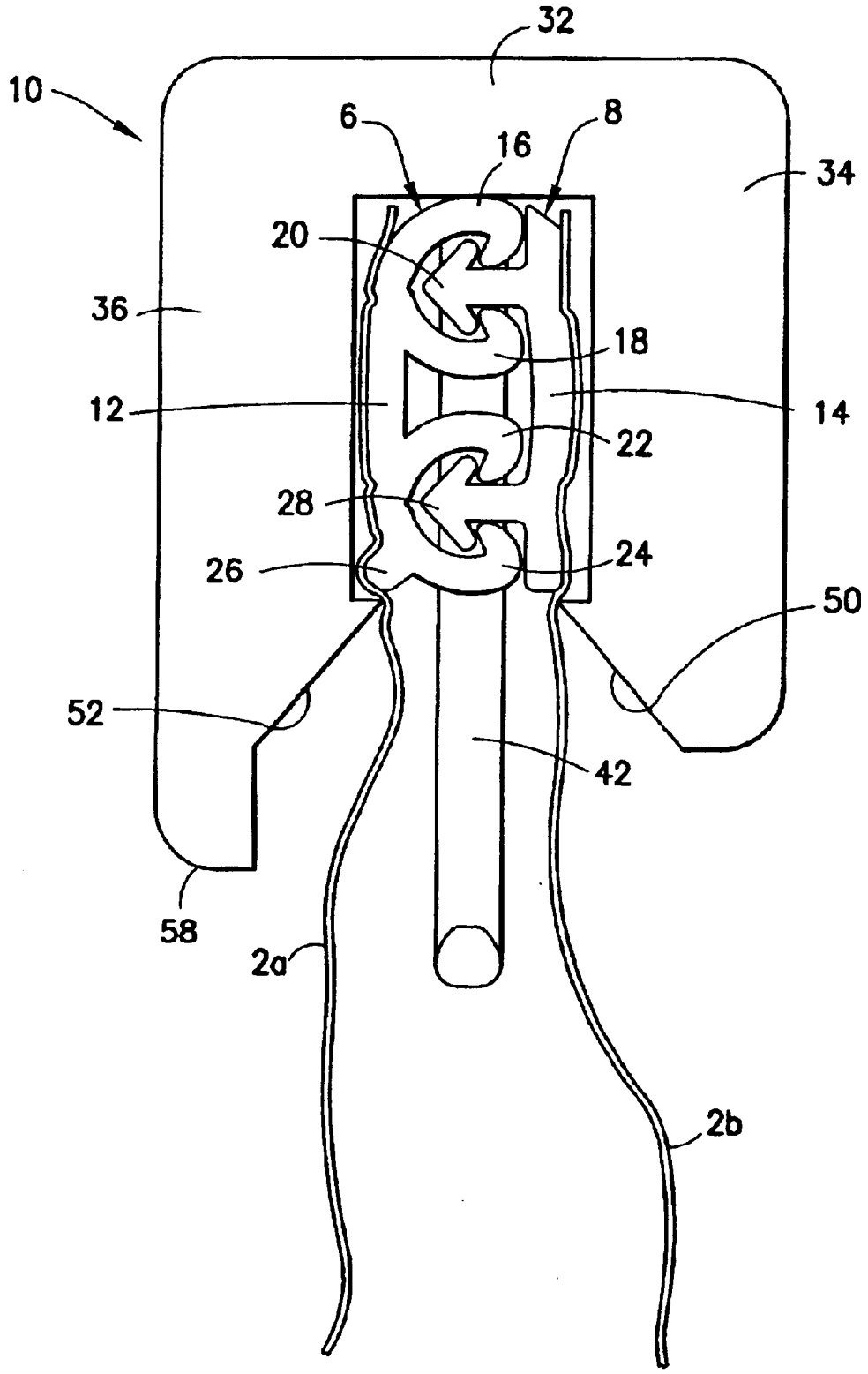
FIG. 2 is a drawing showing a partially sectioned view of one type of slider-string zipper assembly. The zipper is shown sectioned in a plane in front of the closing end of the slider.

At its top end, the receptacle 2 has an openable mouth, on the inside of which is an extruded plastic string zipper 4. The string zipper 4 comprises a pair of interlockable zipper parts or closure strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The top edges of the front and rear walls 2*a* and 2*b* (see FIG. 2) are respectively sealed to the backs of the zipper halves 6 and 8 by a conventional conduction heat sealing technique.

The string zipper is operated by sliding the slider 10 along the zipper parts. As the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The bag shown in FIG. 1 further comprises end stops 66 and 68 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides, forming a vertical hump while at the same time preserving the base of the zipper profile to resist pull-off of the slider. Such stomping can be carried out using ultrasonic welding equipment. A V-shaped notch 48 (see FIG. 3) can be formed in one end or both ends of the slider top wall for receiving the vertical hump of respective formed end stops. This allows the plow to abut against the fused end of the zipper in the zipper fully closed state.

Still referring to FIG. 2, numerals 2*a* and 2*b* indicate opposing walls (made, e.g., of plastic packaging film) of the receptacle. Upper marginal portions of walls 2*a* and 2*b* are joined to the zipper parts 6 and 8, e.g., by heat sealing. The zipper in this example is an extruded plastic structure comprising mutually interlockable profiles. Zipper part 8 comprises a base 14 and two generally arrow-shaped rib-like male closure elements or members 20 and 28, while zipper part 6 comprises two pairs of hook-shaped gripper jaws 16, 18 and 22, 24 connected by a sealing bridge 12. Jaws 16 and 18 receive and interlock with the male element 20, while jaws 22 and 24 receive and interlock with the male element 28. Alternatively, one zipper part could have one male profile and one female profile, while the other zipper part has one female profile and one male profile, or the respective zipper parts could each have more than two male or female profiles.

The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively, as seen in FIG. 2. The upper margins of the bag film may have short free ends that extend beyond the termination points depicted in FIG. 3, provided that the free ends are not so long as to interfere with travel of the slider along the zipper or become entangled with the zipper profiles.

The end face of upper edge of the base 14 that carries the male closure elements 20 and 28 is inclined at about a 45° angle to facilitate loading of the slider onto the zipper from above without snagging on a corner of the upper edge. The bottom edge 8 of the base 14 cooperates with a retaining ledge on the slider (to be described later) to increase the slider-pull-off resistance. For the same purpose, a rib 26 is formed on zipper part 6, the rib 26 cooperating with a retaining ledge on the other side of the slider.

In the slider-zipper assembly shown in FIG. 2, the slider 10 for opening or closing the reclosable zipper is generally shaped so that the slider straddles the zipper profiles. The upper margins of the bag walls 2*a* and 2*b*, which are joined to the backs of the zipper parts 6 and 8, are disposed between the respective zipper parts and the respective side walls of the slider.

Figure 3:
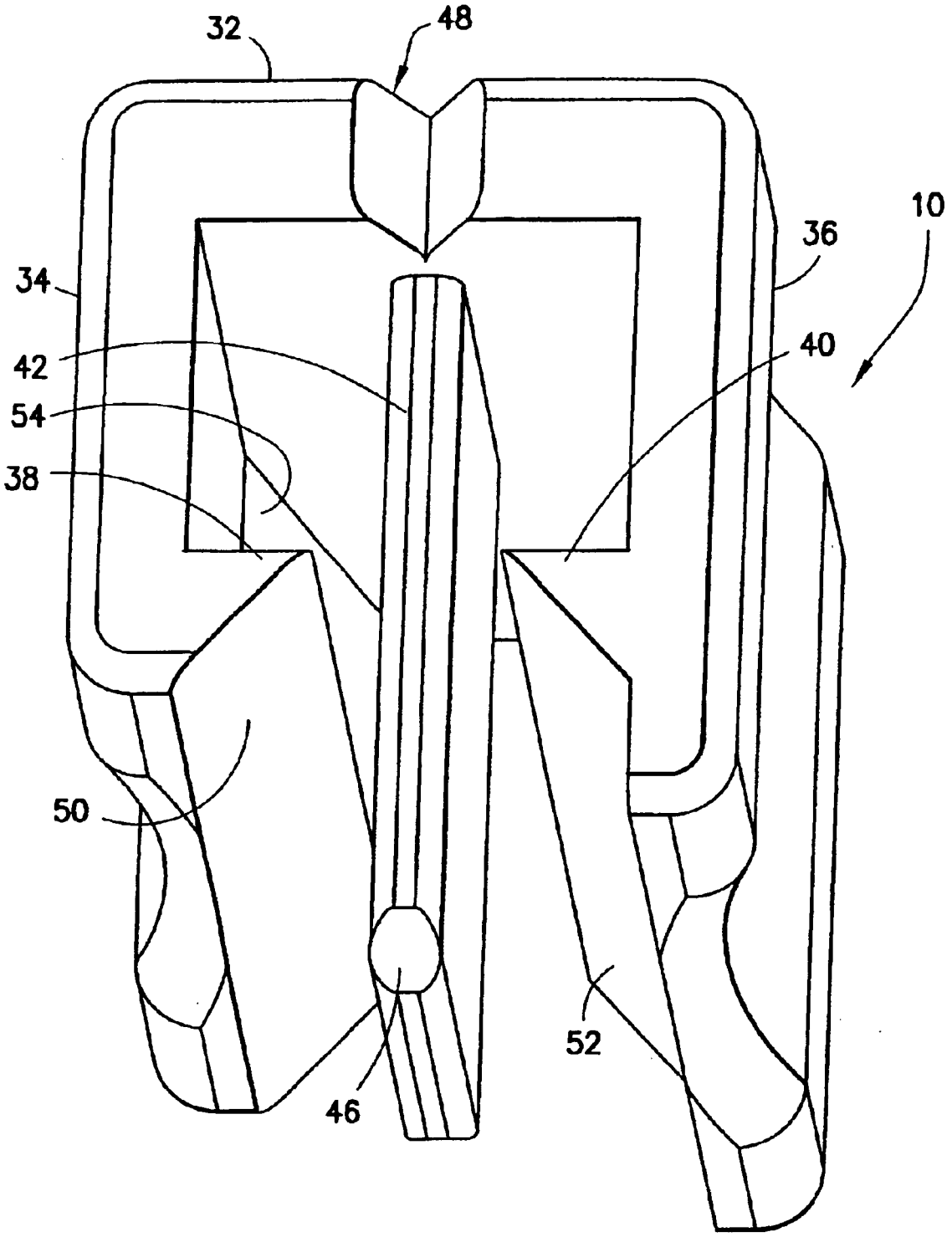
FIG. 3 is a drawing showing an isometric view of the slider incorporated in the assembly depicted in FIG. 2.

FIG. 3 shows an isometric view of the slider 10 incorporated in the assembly depicted in FIG. 2. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces (only one of which, designated by numeral 54, is visible in FIG. 3), which converge toward the closing window of the slider. The inclined surfaces (e.g., 54) funnel or squeeze the zipper parts toward each other, causing the zipper profiles to interlock, as the slider is moved in the closing direction. The side walls 34 and 36 are formed with concave curved indentations where the user may place the tips of an index finger and a thumb for gripping the slider. Alteratively, convexities (e.g., ribs) could be formed on the sides of the slider to facilitate grasping.

The slider 10 also comprises a plow or divider 42 that depends downward from a central portion of the top wall 32 to an elevation below the lowermost portions of each side wall. The plow is disposed between opposing sections of the zipper parts that pass through the tunnel. The tip of the plow 42 is truncated and has rounded edges and flattened corners 46 at opposing ends for facilitating insertion of the plow between the zipper profiles without snagging during automated slider insertion. The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart.

In the embodiment depicted in FIG. 3, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance. The ledges 38 and 40 further comprise respective inclined bottom surfaces that extend downward and outward from the respective inner edges of the generally horizontal surfaces. The inclined surfaces 50 and 52 are each substantially planar, with the respective planes of these inclined surfaces intersecting at a line inside the tunnel that is parallel to the longitudinal axis of the slider. The inclined surfaces 50 and 52 serve to guide the respective zipper parts 6 and 8 into the slider tunnel during insertion of the slider onto an open section of the zipper.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Improved slider designs are disclosed in U.S. patent application Ser. No. 10/412,438, entitled "Molded Sliders for Actuating Zippers of Reclosable Packages". In one such design, the each retaining ledge on the interior surface of the slider side walls is replaced by a pair of retaining teeth spaced apart at opposite ends of the slider. These improved sliders can be inserted on zippers using the same equipment disclosed herein.

Figure 4:
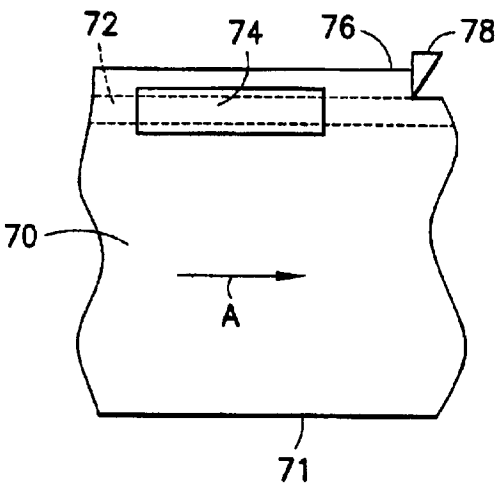
FIG. 4 is a drawing showing a top view of a continuous-movement section of an automated production line for manufacturing the bag depicted in FIG. 1. The zipper-film assembly shown in FIG. 4 is advanced from left to right, as indicated by arrow A.

Reclosable packages of the type having a slider with a plow can be manufactured on an automatic production line. FIG. 4 shows a section of an exemplary production line in which the zipper strips and bag making film are joined while they move continuously. The continuous movement in the section shown in FIG. 4 is converted to intermittent movement in a slider insertion section (not shown) by a conventional dancer assembly (not shown). However, a person skilled in the art will readily appreciate that operations performed in the continuous-movement section shown in FIG. 4 could also be performed on a section of web being moved intermittently.

The operations performed continuously during continuous advancement include: unwinding a continuous web of packaging film from a reel; folding the web of film at a folding board; sealing a string zipper to opposing portions of the folded web; and trimming excess film by cutting the film at an elevation above the zipper-film seals.

FIG. 4 shows a portion of a web 70 of bag making film after the web has been unwound from a reel (not shown) and then passed over a folding board or plow (not shown) that folds the web into a U or V shape. The folded web is pulled through by conventional guide and drive rollers (not shown). In FIG. 4, the dashed lines bounding a strip designated by the numeral 72 represents a string zipper. The fold is designated by the numeral 71. The web of film 70 advances in the direction indicated by arrow A. The web of film is unwound from a roll (not shown), passed over a conventional folding board or plow (not shown) and then pulled through the bag making machine by means of conventional guide and drive rollers (not shown).

String zipper material 72, comprising a pair of interlocked continuous flangeless zipper strips, is unwound from a reel (not shown), fed at an angle (not shown) between the upper portions of the legs of the folded web 70, and guided into a position (shown in FIG. 4) parallel to the machine direction, i.e., parallel to the edges 76 (only one of which is visible in FIG. 4) of the folded web 70. At a zipper sealing station, these marginal portions of the film are joined to the respective backs of the zipper strips by a pair of mutually opposing conventional heated sealing bars 74 (only one of which is visible in FIG. 4).

The zipper sealing station is conventional apparatus and is described hereinafter only briefly. As the folded web 70 with inserted string zipper 4 advances continuously between the opposing sets of sealing bars 74, the respective zipper strips have their backs sealed to the opposing upper marginal portions of the bag making film, thereby continuously attaching incoming sections of the moving string zipper to adjoining sections of the moving web. The sealing is accomplished by electrically heating the sealing bars 74, the heat being conducted through respective endless barrier strips (not shown) made of Teflon or similar material, which circulate on respective sets of rollers (not shown). Each Teflon barrier strips passes between a respective side of the folded web and a respective sealing bar in the gaps between the opposing sealing bars. The web and string zipper are sandwiched between and held together by the Teflon barrier strips, which move with the web and zipper and prevent the bag making film from sticking against the stationary heated sealing bars during conduction heat sealing. The Teflon barrier strips and intervening web and zipper pass through the nips of a series of guide rollers (not shown).

Downstream from the zipper sealing station, the excess film at the web edges and adjacent the string zipper strips is continuously trimmed by a pair of stationary knives 78 (only one of which is visible in FIG. 4). Each knife 78 trims a respective edge portion of the film that extends beyond the zones of film-to-zipper strip joinder. The cutting lines should be located close enough to the respective zipper strips that the remnants of film projecting beyond the zipper are not long enough to interfere with operation of the slider as it moves along the zipper.

The trimmed zipper-film assembly then wends its way through a conventional dancer assembly (not shown), which converts the continuous advancement of the film into intermittent advancement of the film. In the intermittent advancement phase, the zipper-film assembly is moved one package increment and then stopped for a period of time, i.e., the dwell time. This cycle is repeated periodically.

In accordance with an alternative embodiment of the automated production line disclosed above, the web of film material and the string zippers could be moved intermittently through the section depicted in FIG. 4. In this case respective lengths of the string zippers would be sealed to the film (e.g., by reciprocating sealing bars) during each dwell time, with the string zippers and film being advanced an equal length during each interval between successive dwell times. The trimming operation would be performed during advancement of the film.

Figure 5:
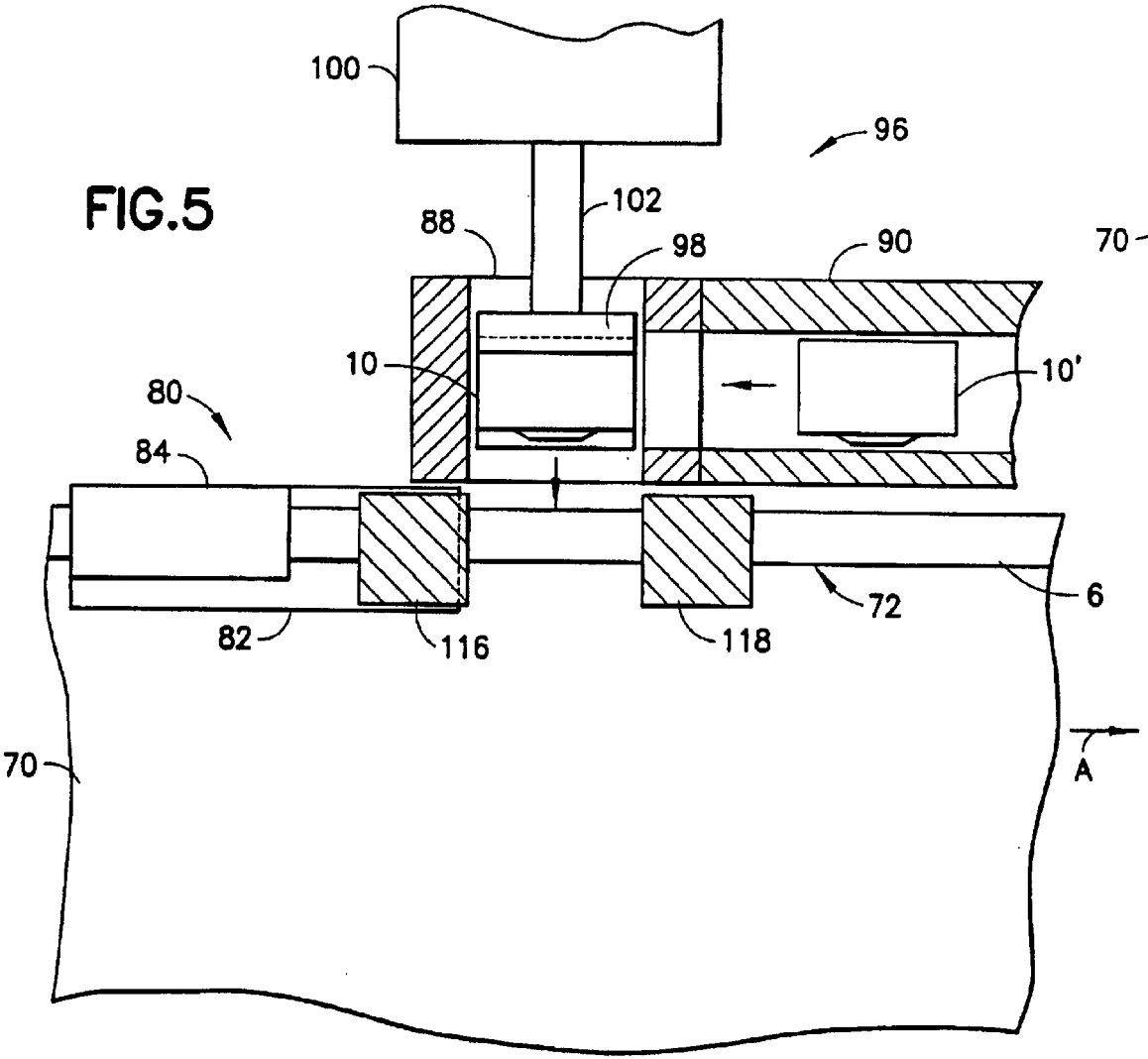
FIG. 5 is a drawing showing a fragmentary, partially sectional top view of the components of a slider insertion station in accordance with one embodiment of the present invention. In this example, the zipper-film assembly moves from left to right, as indicated by arrow A.

Referring to FIG. 5, at the first station after the dancer assembly, the slider (e.g., slider 10 shown in FIG. 3) is inserted onto the zipper-film assembly. The slider insertion station comprises three assemblies (namely, a separator assembly, a pusher assembly and a clamping assembly) that cooperate to insert the slider on the zipper while the zipper is being held open on one side of the slider insertion zone and closed on the other side of the slider insertion zone.

Figure 6:
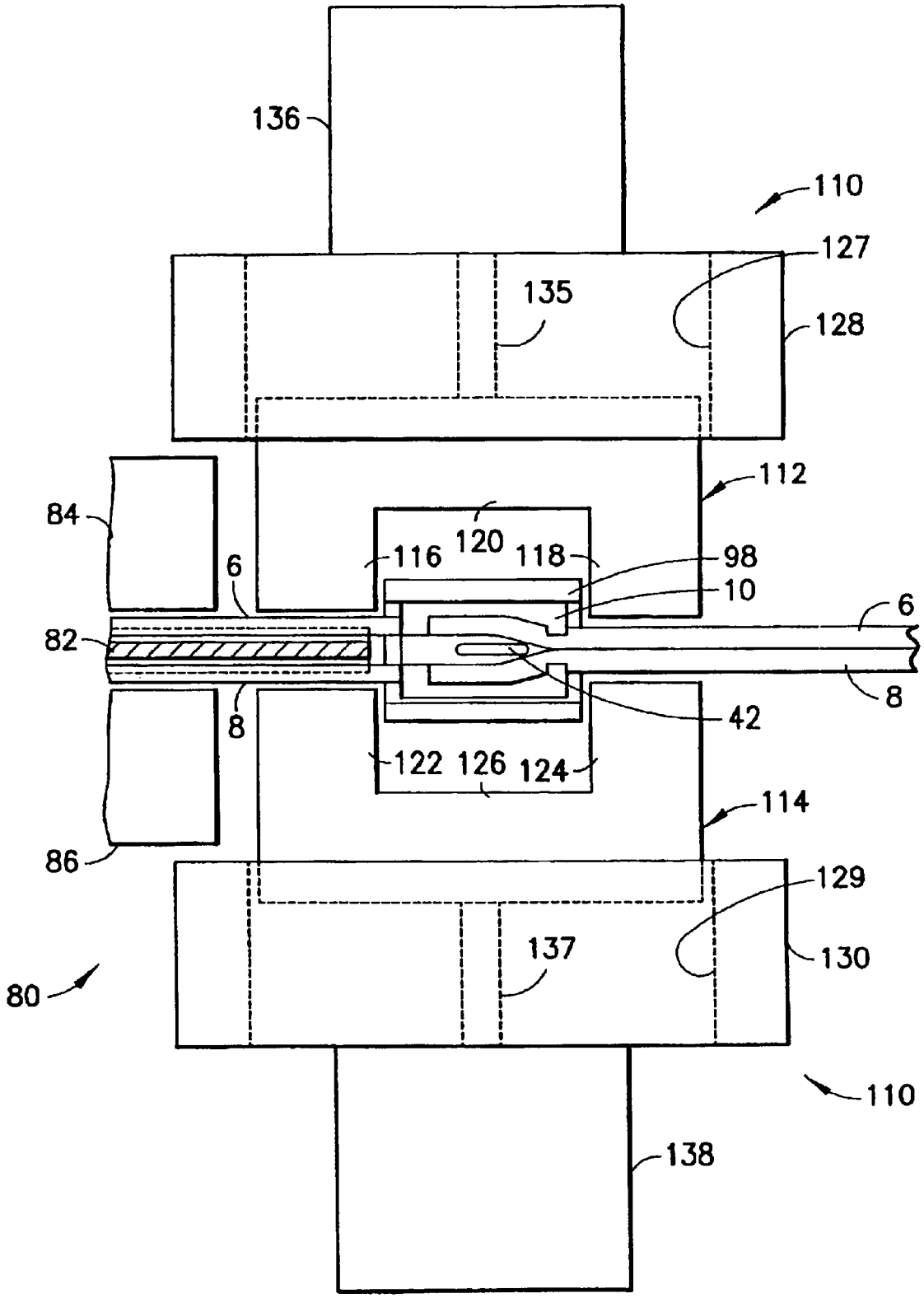
FIG. 6 is a drawing showing a fragmentary, partially sectional front view of the slider insertion components for embodiment depicted in FIG. 5. Again the zipper-film assembly moves from left to right, while the slider is moved in a direction out of the page during insertion.
Figure 7:
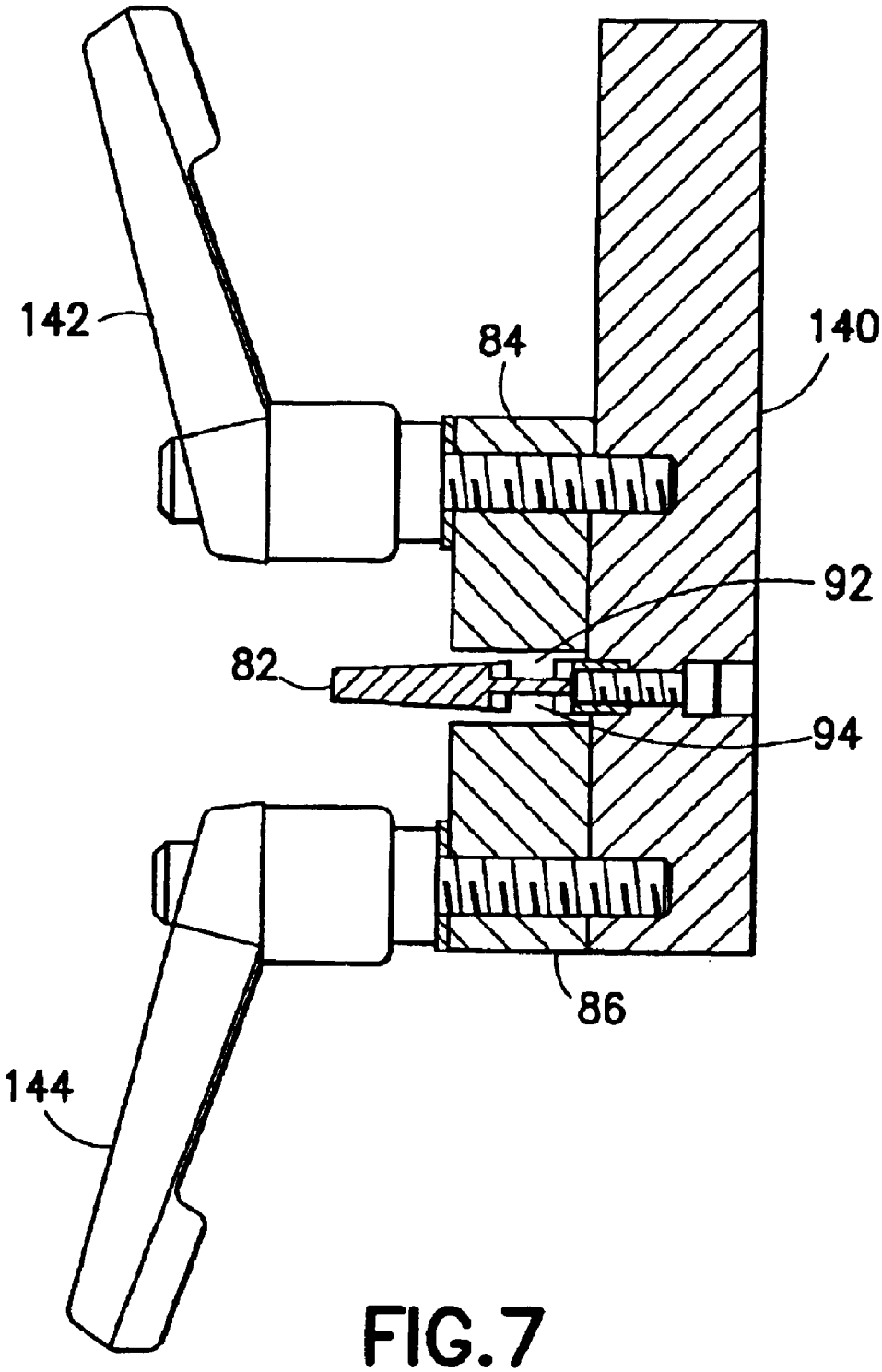
FIG. 7 is a drawing showing a sectional view of a zipper separator assembly in accordance with a different embodiment of the invention wherein the zipper-film assembly are advanced in a direction into the page.

In accordance with the preferred embodiment of the invention shown in FIG. 5, a zippered portion of a folded web 70, comprising a string zipper 72, is pulled through a separator assembly 80. The separator assembly 80 disengages the zipper strips during advancement of the zipper-film assembly, thereby opening the string zipper 72. As best seen in FIG. 7, the separator assembly 80 comprises a central splitter plate 82 separated by gaps from upper (84) and lower (86) guides disposed above and below the splitter plate 82. Only the splitter plate 82 and the upper guide 84 of the separator assembly 80 are visible in FIG. 5. The splitter plate has a pair of mutually parallel grooves 92, 94 (best seen in FIG. 7) on opposite sides thereof, the grooves being aligned with the machine direction. In FIG. 6, the hatched region designated 82 represents a section through the splitter plate along a plane intersecting and parallel to the grooves. The leading edge (not shown) of the portion of the splitter plate between the grooves pries open the advancing interlocked zipper strips. The upper and lower guides 84 and 86 hold the respective separated zipper strips 6 and 8 in the grooves as the zipper strips advance, thereby maintaining the zipper strips in a straight orientation parallel to the machine direction. The upper and lower guides can be separated from the splitter plate to facilitate aligning the zipper in the inserter.

As the zipper-film assembly is pulled in the machine direction through the bag making machine (by conventional means not shown), the grooves 92, 94 and the upper and lower guides 84, 86 (best seen in FIG. 7) prevent cross-directional wandering of the separated zipper strips 6, 8.

Referring again to FIG. 5, the pusher assembly 96 comprises a pusher 98 that pushes a slider 10 onto an open section of the zipper in a slider insertion zone. The pusher displacement is driven by an air cylinder 100. The pusher is fixed to a distal end of a rod 102 of a piston slidable inside the cylinder 100. The pusher 98 is alternately extended and retracted by actuation of the air cylinder 100, which has two separate ports (not shown) for intake of compressed air from separately controlled air lines. The pusher 98 travels along a straight tunnel or channel 88, shown in section in FIG. 5. One side wall of the channel 88 has an opening that communicates with the end of a slider track 90. A succession of sliders 10' are fed periodically along track 90 by a conventional pneumatic slider feeding system (not shown). When the pusher 98 is retracted, the next slider (designated by 10' in FIG. 5) must be automatically fed to a pre-insertion position directly in front of the pusher 98.

Systems for transporting sliders to a slider insertion device are disclosed in U.S. patent application Ser. No. 10/106,687 (incorporated by reference herein) filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 2 has one leg (i.e., side wall 36) longer than the other, to wit, an extension 58 of side wall 36 projects to an elevation lower than the bottom edge of the opposing side wall 34. The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

Figure 8:
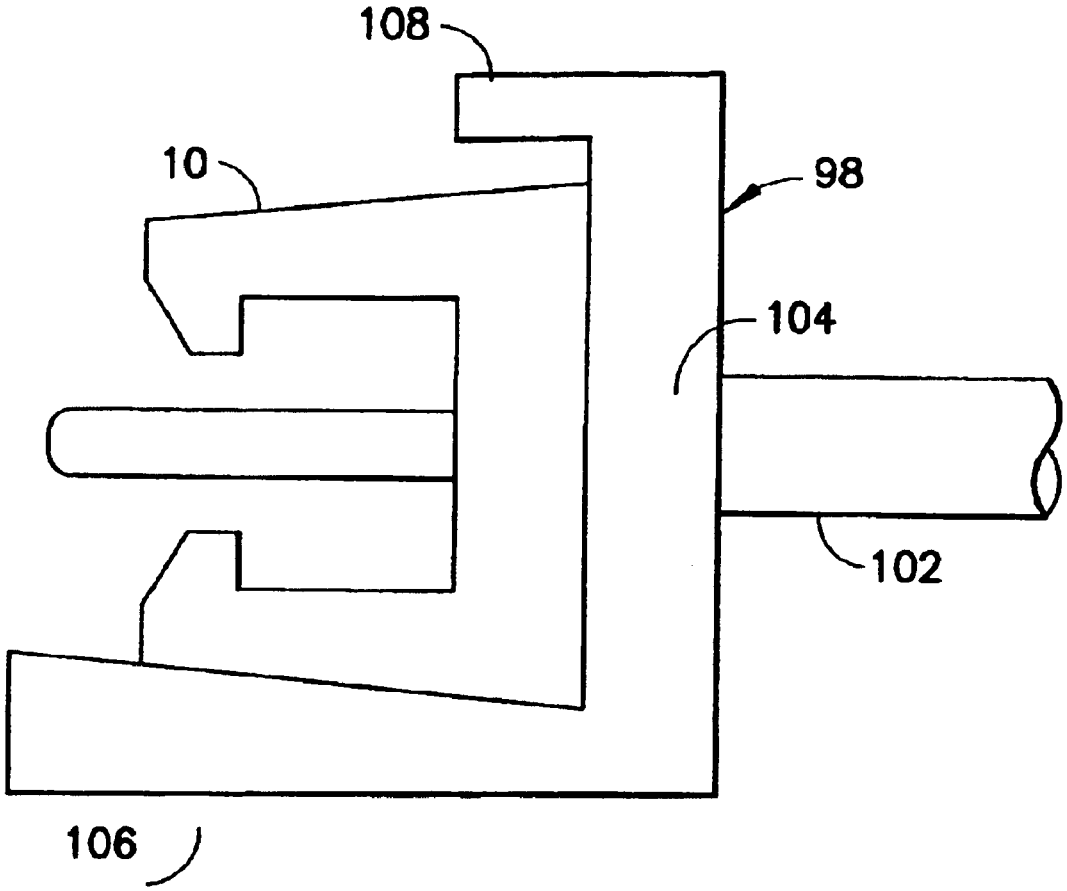
FIG. 8 is a drawing showing a side view of a pusher carrying a slider in accordance with the embodiment depicted in FIGS. 5 and 6.

As shown in FIG. 8, the pusher 98 may be a carriage comprising a base 104 attached to the end of the piston rod 102, a long lower wall 106 on which the slider is placed on one side with its top confronting the pusher base, and a short upper wall 108. The upper surface of the lower wall 106 may be inclined to match any inclination in the confronting side wall of the slider. This feature ensures that the plow of the slider is disposed in a horizontal plane during insertion between the zipper strips along the open portion of the zipper and maintains the slider in a stable configuration with respect to the pusher in order to prevent any relative movement or rocking of the slider in response to acceleration forces or forces produced during insertion. The pusher is open on both sides to provide clearance for the zipper when the pusher is extended and also to allow side feeding of the slider onto the pusher, as seen in FIG. 5.

Referring to FIG. 6, upstream and downstream of the slider insertion zone, the zipper strips 6, 8 are clamped by the clamping assembly 110, which comprises a U-shaped upper clamp 112 and a U-shaped lower clamp 114. The upper clamp 112 comprises an upstream arm 116, a downstream arm 118 and a cross member 120 that is connected to and supports arms 116 and 118. [Arms 116 and 118 are shown in section in FIG. 5.] Similarly, the lower clamp 114 comprises an upstream arm 122, a downstream arm 124 and a cross member 126 that is connected to and supports arms 122 and 124. Each of the four arms of the clamping assembly has a textured end face to provide additional holding force. A portion of the splitter plate 82 is disposed in the space between the confronting end faces of the upstream clamp arms 116 and 122. The downstream arms 118 and 124 are longer than the upstream arms by roughly one-half the thickness of the splitter plate at the grooves. In the preferred embodiment, the end faces of the upstream clamp arms 116 and 122 each have a surface comprising a respective plurality of mutually parallel ridges aligned with the cross direction, while the downstream clamp arms 118 and 124 each have a surface comprising a respective plurality of mutually parallel ridges aligned with the machine direction. This upper and lower clamping arrangement fixes the respective positions of the zipper strips at each end of the slider insertion zone. In particular, the cross-directional ridges on the end faces of the upstream clamp arms, in combination with the splitter plate grooves aligned with the machine direction, fix the positions of the separated zipper strips in both directions. Alternatively, the surface of each clamp arm end face may comprise a multiplicity of projections or teeth arranged in a two-dimensional array. For example, such an array of teeth can be formed by providing a lattice of grooves on the end face.

The upper clamp 112 is moved between retracted and extended positions by an air cylinder 136 mounted on a cylinder mounting block 128. The upper clamp 112 is mounted to the end of a piston rod 135. The cylinder mounting block 128 has a guide channel 127 for guiding the upper clamp 112 during its transit. Similarly, The lower clamp 114 is moved between retracted and extended positions by an air cylinder 138 mounted on a cylinder mounting block 130. The lower clamp 114 is mounted to the end of a piston rod 137. The cylinder mounting block 130 has a guide channel 129 for guiding the lower clamp 114 during its transit. The cylinder mounting blocks 128 and 130 are fixed to a support frame not shown. The same support frame supports the tunnel 88 and the slider track 90 and the cylinder 100 depicted in FIG. 5.

As best seen in FIG. 6, on the upstream side of the slider insertion zone, the clamp arms 116 and 122 clamp the zipper strips 6 and 8 in the grooves of the splitter plate 82. Due to the thickness of the intervening splitter plate, the section of the zipper near the trailing edge of the splitter plate is clamped in an opened state. Conversely, on the downstream side of the slider insertion zone, the clamp arms 118 and 124 clamp the adjoining section of the zipper closed. Thus, the upper and lower clamps of the clamping assembly 110 serve to stabilize the zipper during slider insertion in the zone between the upstream and downstream arms of the clamps. The zipper strips are held in respective positions such that the slider plow 42 enters the gap between the zipper strips and then the slider side walls respectively pass over the zipper strips during slider insertion. The slider is pushed onto the zipper until the retaining ledges on the slider interior latch under the zipper strips to hold the slider securely on the zipper. The proximity of closed zipper to the closing end of the slider and the presence of open zipper at the opening end of the slider and adjacent the plow facilitates insertion of the slider onto the zipper. In particular, one function of the splitter plate and clamp arrangement is to create a funnel shape with the zipper opening so that the slider plow can project between the zipper strips during insertion.

The interior surfaces of the arms of the U-shaped clamps can be mutually parallel and separated by a distance slightly greater than the width of the pusher. This enables the interior surfaces of the clamp arms to act as extensions of the sidewalls of the pusher channel. This will provide further confinement and alignment of the clip in the pusher as the pusher extends during slider insertion.

During the same dwell time that a slider is being inserted, a slider end stop structure is being formed on the zipper at an ultrasonic stomping station (not shown) downstream from the slider insertion zone. This slider end stop structure will be bisected later during cutting by a hot knife (not shown) to form two slider end stops, i.e., the end stop at the zipper fully closed slider park position for one package and the end stop at the zipper fully open slider park position for the next package. The end stop structure is typically formed by an ultrasonic stomping assembly comprising a horn and an anvil (not shown in the drawings). The horn transmits sufficient ultrasound wave energy into the plastic zipper material that the material is fused into a structure (e.g., a vertically extending hump) defined by the surfaces of the horn and anvil. The horn and anvil may be of the reciprocating or rotary variety.

As seen in FIG. 7, the separator assembly comprises a central splitter plate 82 having a pair of grooves or channels 92 and 94 formed on either side thereof that guide the respective zipper strips (not shown in FIG. 7) as the neck between the grooves pries the moving zipper strips apart. The splitter plate 82 may have parallel sides or may taper linearly from the neck to the distal edge thereof, as depicted in FIG. 7. As previously described, the separator assembly further comprises an upper guide 84 and a lower guide 86, which are positioned on opposing sides of the splitter plate 82 with respective gaps therebetween for passage of the respective walls of the film web (not shown in FIG. 7). The upper and lower guides 84 and 86 hold the respective zipper strips in the respective grooves 92 and 94 formed in the splitter plate 82. Thus, as the zipper-film assembly is pulled through the bag making machine, the splitter plate 82 will pry open successive package-length sections of zipper during successive zipper-film advancements, assuming that each advance is equal to one package length.

To facilitate threading of the zipper strips through the separator assembly, the upper and lower guides 84 and 86 can be pivoted (e.g., about 5 degrees) away from the splitter plate 82 to allow the zipper strips to be passed between the splitter plate and the upper and lower guides. Upper guide 84 can be pivoted manually upward after the adjustable handle 142 has been untightened, while lower guide 86 can be pivoted downward (under the force of gravity) after the adjustable handle 144 has been untightened. The splitter plate 82 is independently mounted to a base 140, while the upper and lower guide mounts 84, 86 are pivotably mounted to the base 140. The upper and lower guides are locked in place by tightening of the respective handles 142 and 144. The base 140 is part of the support frame.

Figure 9:
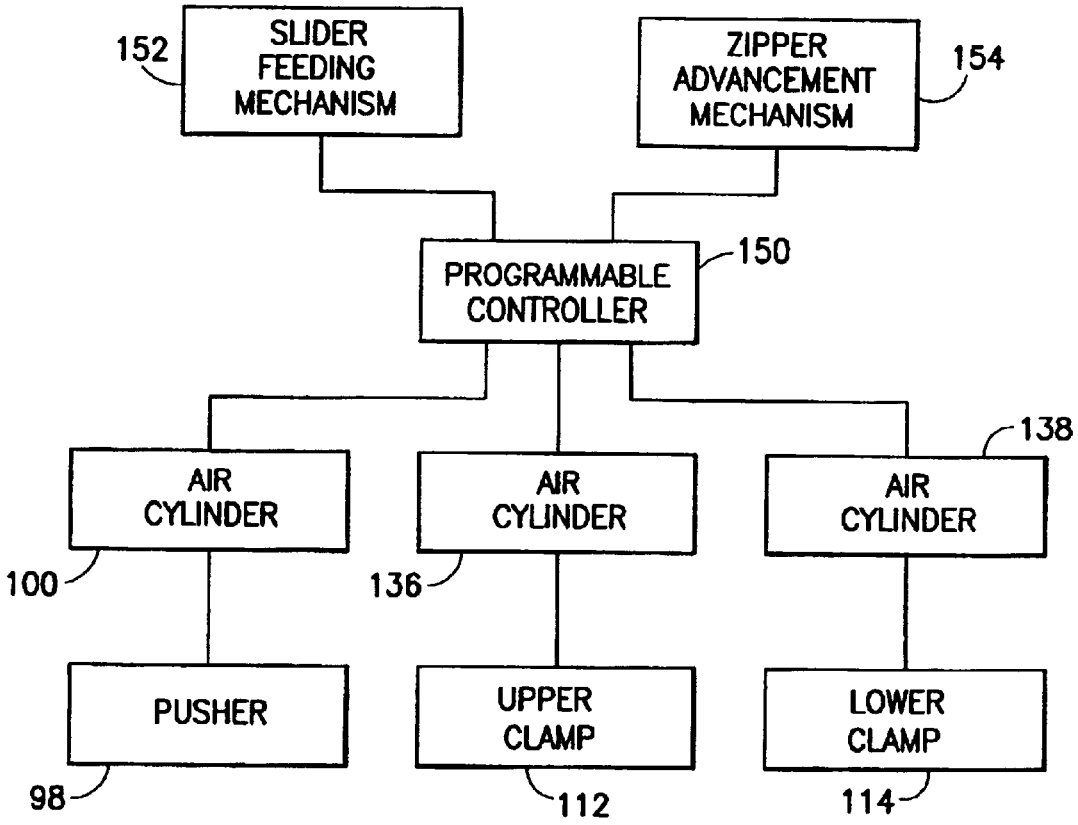
FIG. 9 is a block diagram generally representing programmable control of many of the components of the disclosed embodiment.

As previously mentioned, the extension and retraction of the pusher 98, the upper clamp 112 and the lower clamp 114 are achieved in the disclosed embodiment by means of respective air cylinders 100, 136 and 138, generally represented in FIG. 9. Alternatively, hydraulic cylinders could be used. Operation of the cylinders is controlled by a programmable controller 150, which selectively activates the supply of fluid to the cylinders in accordance with an algorithm or logical sequence. The controller may also take the form of a computer or a processor having associated memory that stores a computer program for operating the machine. The controller 150 is programmed to actuate the cylinders in the following order: first, cylinders 136 and 138 are actuated to extend the clamps 112 and 114; then the cylinder 100 is actuated to extend the pusher 98. These operations are performed during a dwell time, i.e., while the zipper is stationary. After each dwell time, the zipper is advanced (with or without attached bag making film) by a conventional zipper advancement mechanism 154 that is also controlled by the controller 150. In the case where bag making film is attached to the zipper, the zipper advancement mechanism may comprise drive rollers that pull the film forward. During zipper advancement, the controller 150 may also activate a slider feeding mechanism 152, causing the next slider in line to be moved to a pre-insertion position on the pusher.

A person skilled in the art of machinery design will readily appreciate that displacing means other than cylinders can be used to displace the clamps and the pusher. Any other known mechanical displacement means can be used. For the sake of illustration, such mechanical displacement devices include a rack and pinion arrangement, rotation of the pinion being driven by an electric motor, or a linear actuator with ball screw driven by an electric motor.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. An apparatus comprising:

a pusher linearly movable without rotation from a retracted position to an extended position for inserting a slider onto a first section of a zipper comprising mutually interlockable first and second zipper strips;

first and second guides disposed on opposite sides of a second section of said zipper;

first and second grippers respectively disposed on opposite sides of a third section of said zipper disposed between said first and second sections, each of said first and second grippers being linearly movable without rotation between respective extended and retracted positions to grip said zipper when said grippers are in said extended positions and to not grip said zipper when said grippers are not in said extended positions;

third and fourth grippers respectively disposed on opposite sides of a fourth section of said zipper, said first section being disposed between said third and fourth sections, each of said third and fourth grippers being linearly movable without rotation between respective extended and retracted positions to grip said zipper when said grippers are in said extended positions and to not grip said zipper when said grippers are not in said extended positions; and a splitter plate disposed between said first and second zipper strips along said second and third sections.

2. The apparatus as recited in claim 1, further comprising a channel for said pusher, said channel comprising first and second sidewalls, said first and second sidewalls of said pusher channel being mutually parallel, wherein said first and third grippers have interior surfaces generally coplanar with said first channel sidewall, and said second and fourth grippers have interior surfaces generally coplanar with said second channel sidewall.

3. The apparatus as recited in claim 1, wherein said splitter plate comprises a first groove facing said first guide and a second groove facing said second guide, said first and second grooves being aligned with a machine direction, said first zipper strip along said second and third sections of said zipper being seated in said first groove, and said second zipper strip along said second and third sections of said zipper being seated in said second groove.

4. The apparatus as recited in claim 1, wherein each of said first through fourth grippers comprises a textured end face that contacts said zipper when said first through fourth grippers are in their respective extended positions.

5. The apparatus as recited in claim 4, wherein said textured end faces of said first and second grippers each comprise a respective plurality of mutually parallel ridges aligned with a cross direction.

6. The apparatus as recited in claim 4, wherein said textured end faces of said third and fourth grippers each comprise a respective plurality of mutually parallel ridges aligned with a machine direction.

7. The apparatus as recited in claim 1, wherein said first and third grippers are fixed relative to each other and move in unison, and said second and fourth grippers are fixed relative to each other and move in unison.

8. The apparatus as recited in claim 7, wherein each of said first through fourth grippers comprises a respective end face that contacts said zipper when said first through fourth grippers are in their respective extended positions, said end faces of said first and second grippers being separated by a first distance and said end faces of said third and fourth grippers being separated by a second distance less than said first distance when said first through fourth grippers are in their respective extended positions.

9. The apparatus as recited in claim 1, wherein said pusher comprises a base that bears against a top wall of said slider, and a side wall that contacts a side wall of said slider, said side wall of said pusher having an angled interior surface that is not perpendicular to said base of said pusher.

10. The apparatus as recited in claim 1, further comprising:

a first translation mechanism for linearly moving both of said first and third grippers in either of first and second transverse directions without rotation;

a second translation mechanism for linearly moving both of said second and fourth grippers in either of first and second transverse directions without rotation;

a third translation mechanism for linearly moving said pusher in either of first and second elevational directions without rotation; and a programmed controller that coordinates the operation of said first through third translation mechanisms so that said first and third grippers translate in one of said first and second transverse directions while said second and fourth grippers translate in the other of said first and second transverse directions, and so that said pusher inserts a slider onto said first section of said zipper while said first and second grippers grip said third section of said zipper and said third and fourth grippers grip said fourth section of said zipper.

11. The apparatus as recited in claim 10, wherein each of said first through third translation mechanisms comprises a respective air cylinder.

12. The apparatus as recited in claim 10, further comprising means for advancing said zipper, wherein said programmed controller is programmed to control said advancing means and said first, second and third translation mechanisms so that said zipper is advanced while said grippers and said pusher are in their respective retracted positions.

13. A slider insertion machine comprising:

a pusher linearly movable without rotation from a retracted position to an extended position for inserting a slider into a predetermined volume of space and onto a first section of a zipper that spans said predetermined volume of space in a machine direction, said zipper comprising first and second zipper strips;

first and second clamps respectively disposed on opposite sides of said zipper, each of said first and second clamps being linearly movable without rotation between respective extended and retracted positions to clamp second and third sections of said zipper when said clamps are in said extended positions and to not clamp said zipper when said clamps are not in said extended positions; and a plate comprising a first portion disposed between said first and second zipper strips in said second section of said zipper, wherein said first clamp comprises first and second arms connected by a first cross member and having respective end faces, said second clamp comprises third and fourth arms connected by a second cross member and having respective end faces that oppose the respective end faces of said first and second arms, said distal portion of said plate is disposed between said opposing end faces of said first and third arms, and at least a portion of said pusher is disposed between said first and second cross members in a transverse direction when said pusher is in its extended position.

14. The machine as recited in claim 13, wherein each of said first and second clamps is generally U-shaped and straddles a respective portion of said predetermined volume of space when said clamps are in said extended positions.

15. The machine as recited in claim 13, wherein said plate has first and second grooves on opposing sides thereof and aligned with said machine direction, a first portion of said first groove facing said end face of said first arm and a first portion of said second groove facing said end face of said third arm.

16. The machine as recited in claim 15, further comprising first and second guides disposed on opposite sides of a second portion of said plate, a second portion of said first groove facing said first guide and a second portion of said second groove facing said second guide.

17. The machine as recited in claim 13, wherein said end faces of said first through fourth arms have textured surfaces.

18. The machine as recited in claim 17, wherein said textured end faces of said first and third arms each comprise a respective plurality of mutually parallel ridges aligned with a cross direction.

19. The machine as recited in claim 17, wherein said textured end faces of said second and fourth arms each comprise a respective plurality of mutually parallel ridges aligned with a machine direction.

20. The machine as recited in claim 13, wherein said first arm is longer than said second arm, and said third arm is longer than said fourth arm.

21. The machine as recited in claim 13, further comprising a first cylinder for moving said first clamp, a second cylinder for moving said second clamp, and a third cylinder for moving said pusher.

22. The machine as recited in claim 13, further comprising a channel for said pusher, said channel comprising first and second sidewalls, said first and second sidewalls of said pusher channel being mutually parallel, wherein said first clamp has one interior surface generally coplanar with said first channel sidewall and another interior surface generally coplanar with said second channel sidewall, and said second clamp has one interior surface generally coplanar with said first channel sidewall and another interior surface generally coplanar with said second channel sidewall.

* * * * *